United States Patent [19]

Kinoshita et al.

[11] Patent Number: 5,061,959

[45] Date of Patent: Oct. 29, 1991

[54] PHOTOGRAPHIC RECORDING APPARATUS HAVING PHOTOCONDUCTIVE DRUM CARTRIDGE UNIT WITH AUTOMATICALLY CLOSED OPENINGS

[75] Inventors: Naohisa Kinoshita; Hiroyuki Kashima; Makoto Hasegawa, all of Nagoya; Toshihiro Tsuzuki, Kariya; Kiyoshi Muto, Yokkaichi, all of Japan

[73] Assignee: Brother Kogyo Kabushiki Kaisha, Aichi, Japan

[21] Appl. No.: 573,682

[22] Filed: Aug. 28, 1990

[30] Foreign Application Priority Data

Sep. 1, 1989 [JP] Japan ..... 1-103314

[51] Int. Cl.[5] ..... G03G 15/00

[52] U.S. Cl. ..... 355/210; 346/160.1; 355/200; 355/211

[58] Field of Search ..... 355/200, 210, 211, 212, 355/260; 346/160.1

[56] References Cited

U.S. PATENT DOCUMENTS

| | | | |
|---|---|---|---|
| 4,470,689 | 9/1984 | Nomura et al. | 355/211 |
| 4,588,280 | 5/1986 | Ogawa et al. | 355/200 |
| 4,607,941 | 8/1986 | Honda | 355/210 |
| 4,708,455 | 11/1987 | Kubota et al. | 355/211 |
| 4,862,209 | 8/1989 | Sakamoto et al. | 355/211 |
| 4,862,212 | 8/1989 | Tanzawa et al. | 355/260 X |
| 4,876,572 | 10/1989 | Nagatsuma | 355/200 X |
| 4,908,661 | 5/1990 | Iwata et al. | 355/211 |
| 4,965,633 | 10/1990 | Surti | 355/200 |

FOREIGN PATENT DOCUMENTS

| | | | |
|---|---|---|---|
| 0110168 | 5/1986 | Japan | 355/210 |
| 62-33581 | 7/1987 | Japan . | |

*Primary Examiner*—A. T. Grimley
*Assistant Examiner*—J. E. Barlow, Jr.
*Attorney, Agent, or Firm*—Oliff & Berridge

[57] ABSTRACT

A photographic recording apparatus is provided having a housing body, and a process cartridge unit including a photoconductive drum and a developing device and which is removably mounted on the housing body. The cartridge unit includes a first and a second frame which are pivotable about a rotation axis of the drum relative to each other, and a biasing member for biasing the two frames to thereby hold the frames in a first relative angular position. The housing body includes a portion for holding the cartridge unit such that the two frames are held in a second relative angular position, which is established by pivoting the two frames from the first relative angular position against a biasing action of the biasing member. The first and second frames each having holes or openings that are initially misaligned, cooperate in an overlapping fashion to provide at least one opening through which a portion of the drum is exposed outside the frames, when the frames are placed in the second relative angular position. Each opening is closed when the frames are placed in the first relative angular position.

17 Claims, 4 Drawing Sheets

PHOTOGRAPHIC RECORDING APPARATUS HAVING PHOTOCONDUCTIVE DRUM CARTRIDGE UNIT WITH AUTOMATICALLY CLOSED OPENINGS

BACKGROUND OF THE INVENTION

1. Field of the Invention

The present invention relates to a photographic recording apparatus which has a process cartridge unit including a photoconductive drum.

2. Discussion of the Prior Art

A photographic recording apparatus is known, which has a housing body, and a process cartridge unit which includes a photoconductive drum and a developing device and which is removably mounted on the housing body. An example of such a photographic recording apparatus is disclosed in laid-open Publication No. 62-33581 of examined Japanese Patent Application. In this apparatus, the removably mounted process cartridge unit includes a frame in which the photoconductive drum, developing device and other components are accommodated. The frame of the cartridge unit has an opening or openings through which an appropriate portion or portions of the drum is/are exposed to the outside of the frame. The frame is provided with a covering member or members disposed adjacent to the opening or openings, for closing the opening or openings to protect the photoconductive drum from exposure to light when the cartridge unit is removed from the recording apparatus.

In the recording apparatus described above, the process cartridge unit may be replaced with a new one when the toner in the developing device is exhausted or the expected service life of the cartridge unit is reached. Each opening provided in the frame of the new process cartridge unit is closed by the appropriate covering member before mounting on the apparatus. After the new cartridge unit is installed on the apparatus, the covering member is operated to open the opening. Thus, this type of process cartridge unit is protected from deterioration of the photoconductive drum due to exposure to light, and damage due to contact with surrounding components or other objects during storage of the unit or installation of the unit on the apparatus. Therefore, the use of a process cartridge unit facilitates the replacement of the exhausted components and the maintenance procedure of the apparatus.

Some photographic recording apparatus may be adapted to selectively use process cartridge units containing toners of different colors. Upon interchanging the cartridge units for different colors, the openings formed through the frame of the cartridge unit of each color are closed while the units are not installed in place on the recording apparatus, and while the units are stored. Further, the openings are closed during maintenance operations for removing paper jammed in the apparatus, for example. In these cases, too, the photoconductive drum is protected from light exposure.

Where the frame of a process cartridge unit as indicated above has two or more openings or apertures, it is necessary to provide the frame with two or more covering members for the respective openings. Moreover, a suitable exclusive actuating device or devices is/are required to operate the covering members to open and close the openings. Consequently, the cost of manufacture of the recording apparatus is accordingly increased. Where the actuating device is manually operated, the replacement or interchange of the cartridge unit is cumbersome.

SUMMARY OF THE INVENTION

It is therefore an object of the present invention to provide a photographic recording apparatus having a process cartridge unit which is simple in construction, and wherein the opening or openings of the frame of the cartridge unit is/are automatically opened and close upon installation and removal of the cartridge unit.

The above object may be achieved according to the principle of the present invention, which provides a photographic recording apparatus having a housing body, and a process cartridge unit which includes a rotatable photoconductive drum and a developing device and which is removably mounted on the housing body, the process cartridge unit including a first frame which supports the devloping device and which is pivotable about an axis of rotation of the photoconductive drum, a second frame which is pivotable about the axis of rotation relative to the first frame, and biasing means for biasing the first and second frames and thereby holding the first and second frames in a first relative angular position. The housing body includes a cartridge holding portion for holding the process cartridge unit such that the first and second frames are held in a second relative angular position which is established by pivoting the first and second frames relative to each other from the first relative angular position against a biasing action of the biasing means. The first and second frames cooperate with each other to provide at least one opening through which a portion of the photoconductive drum is exposed to an outside of the first and second frames, when the first and second frames are placed in the second relative angular position. Each opening is closed when the first and second frames are placed in the first relative angular position.

According to the photographic recording apparatus of the present invention constructed as described above, the first and second frames of the cartridge unit are brought to the first relative angular position by the biasing force of the biasing means when the cartridge unit is released from the cartridge holding portion of the housing body. Accordingly, each opening which is formed through the cartridge unit during use on the apparatus is automatically closed when the cartridge unit is removed from the apparatus. This arrangement protects the photoconductive drum from exposure to light while the cartridge unit is not in use. When the cartridge unit is mounted on the apparatus with the cartridge holding portion, the first and second frames of the cartridge unit are pivoted relative to each other to the second relative angular position against the biasing force of the biasing means, whereby the opening or openings is/are formed to expose the appropriate portion or portions of the drum to the outside of the frames, thereby permitting a recording operation on the apparatus.

It is significant to note that the present recording apparatus eliminates covering means for closing the opening or openings of the cartridge unit, and operator-controlled means for operating the covering means to open and close each opening as needed. Therefore, the cost of manufacture of the apparatus is accordingly lowered. Where the cartridge unit has two or more openings, all of these openings are closed to protect the photoconductive drum from exposure to light upon removal of the cartridge unit from the housing body of the apparatus, and opened to permit a recording operation of the apparatus upon installation of the cartridge unit on the housing body. This eliminates the conventionally required manipulation of the operator-controlled means for operating the covering means, and consequently reduces the time and efforts required to change or replace the cartridge unit.

The first and second frames of the process cartridge unit may have respective covering portions which are movable relative to each other and which cover a part of a circumference of the photoconductive drum such that the covering portions partially overlap each other. These covering portions cooperate to provide at least one when the first and second frames are placed in the second relative angular position. In this case, each of the covering portions of the first and second frames has at least one hole formed therethrough. The hole or holes of the first frame and the hole or holes of the second frame are misaligned with each other in the first relative angular position, and are aligned with each other to provide at least one opening when the frames are placed in the second relative angular position. For example, each of the covering portions of the first and second frames has two holes formed therethrough to provide two openings in the second relative angular position.

The first frame of the cartridge unit may include a developer support portion for supporting the developing device, and a covering portion which is adjacent to the developer support portion and which covers a part of a circumference of the photoconductive drum when the first and second frames are placed in the first relative angular position. On the other hand, the second frame may be adapted to include a covering portion which covers another part of the circumference adjacent to the part when the first and second frames are placed in the first relative angular position. In this arrangement, the covering portions of the first and second frames have respective ends which are spaced apart from each other in a circumferential direction of the drum to thereby define an opening therebetween when the first and second frames are placed in the second relative angular position. The present arrangement may be adapted such that the process cartridge unit further includes a cleaner, and the first frame further includes a toner storage portion for storing a toner which is applied to a circumferential surface of the photoconductive drum by the developing device. In this case, the covering portion of the second frame may include a cleaner support portion for supporting the cleaner, and the cleaner support portion has an end which cooperates with the end of the covering portion of the first frame to define a toner transfer opening through which the toner is transferred from the circumferential surface of the drum to a recording medium. The cleaner is located downstream of the toner transfer opening in a rotating direction of the drum, and operates to remove the toner which remains on the circumferential surface.

In a preferred form of the invention, the cartridge holding portion of the housing body includes first, second and third support means for supporting the process cartridge unit at the photoconductive drum, the first frame and the second frame, respectively, when the first and second frames are placed in the second relative angular position. When the first and second frames are placed in the first relative angular position, the second and third support means support the process cartridge unit in contact with the first and second frames, respectively, with the -photoconductive drum being disengaged from the first support means. The drum and the first support means engage each other when the first and second frames are pivoted relative to each other about the axis of rotation to the second relative angular position. For instance, the photoconductive drum may have a shaft portion which engages the first support means when the first and second frames are pivoted about the shaft portion to the second relative angular position. The first support means may have a U-shaped groove which is open so as to engage the shaft portion when the first and second frames are pivoted to the second relative angular position.

In one arrangement of the above form of the invention, the apparatus may further comprise a covering member which is supported by the housing body pivotally between an open and a closed position. The covering member in the closed position cooperates with the housing body to enclose the process cartridge unit. The covering member has retainer means which extends toward an interior of the housing body and which is engageable with the shaft portion of the photoconductive drum to pivot the first and second frames from the first relative angular position to the second relative angular position when the covering member is member may include a top plate from which the retaining means extends downward for engagement with the shaft portion of the photoconductive drum when the covering member is moved to the closed position.

The cartridge unit may have an opening in the form of an exposing aperture through which a circumferential surface of the -photoconductive drum is exposed to a light beam representative of an original image to be reproduced, so that a latent image corresponding to the original image is formed on the circumferential surface. The cartridge unit may further have another opening in the form of an image transfer opening through which a visible image developed from the latent image by the developing device is transferred to a recording medium.

The photographic recording apparatus of the present invention may be a laser printer which has a laser scanner unit for exposing a circumferential surface of the photoconductive drum through an opening, to a laser beam representative of an original image to be reproduced.

BRIEF DESCRIPTION OF THE DRAWINGS

The above and other objects, features and advantages of the present invention will be better understood by reading the following detailed description of a presently preferred embodiment of the invention, when considered in connection with the accompanying drawings, in which.

DETAILED DESCRIPTION OF THE PREFERRED EMBODIMENT

Figure 1:
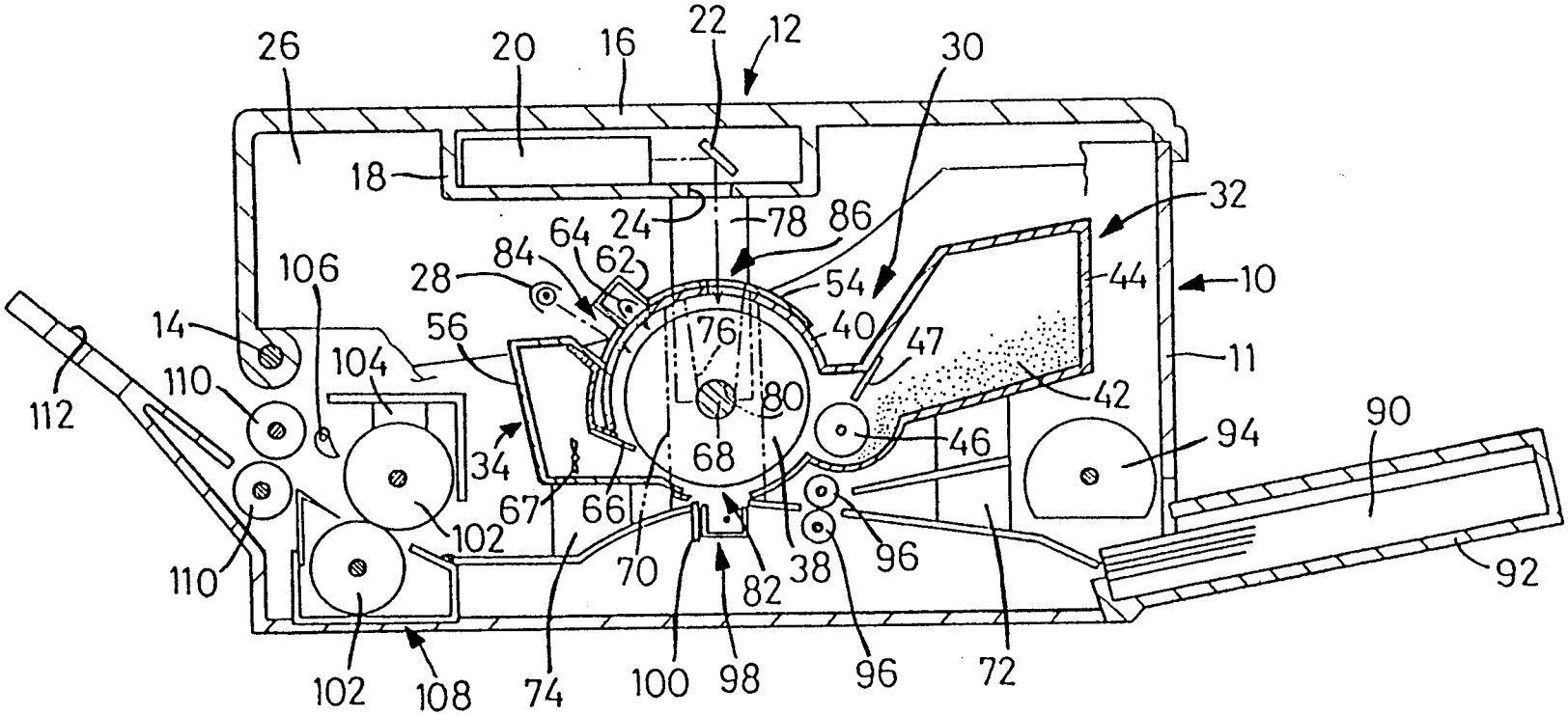
FIG. 1 is a front elevational view in cross section of one embodiment of the present invention in the form of a laser printer.
Figure 2:
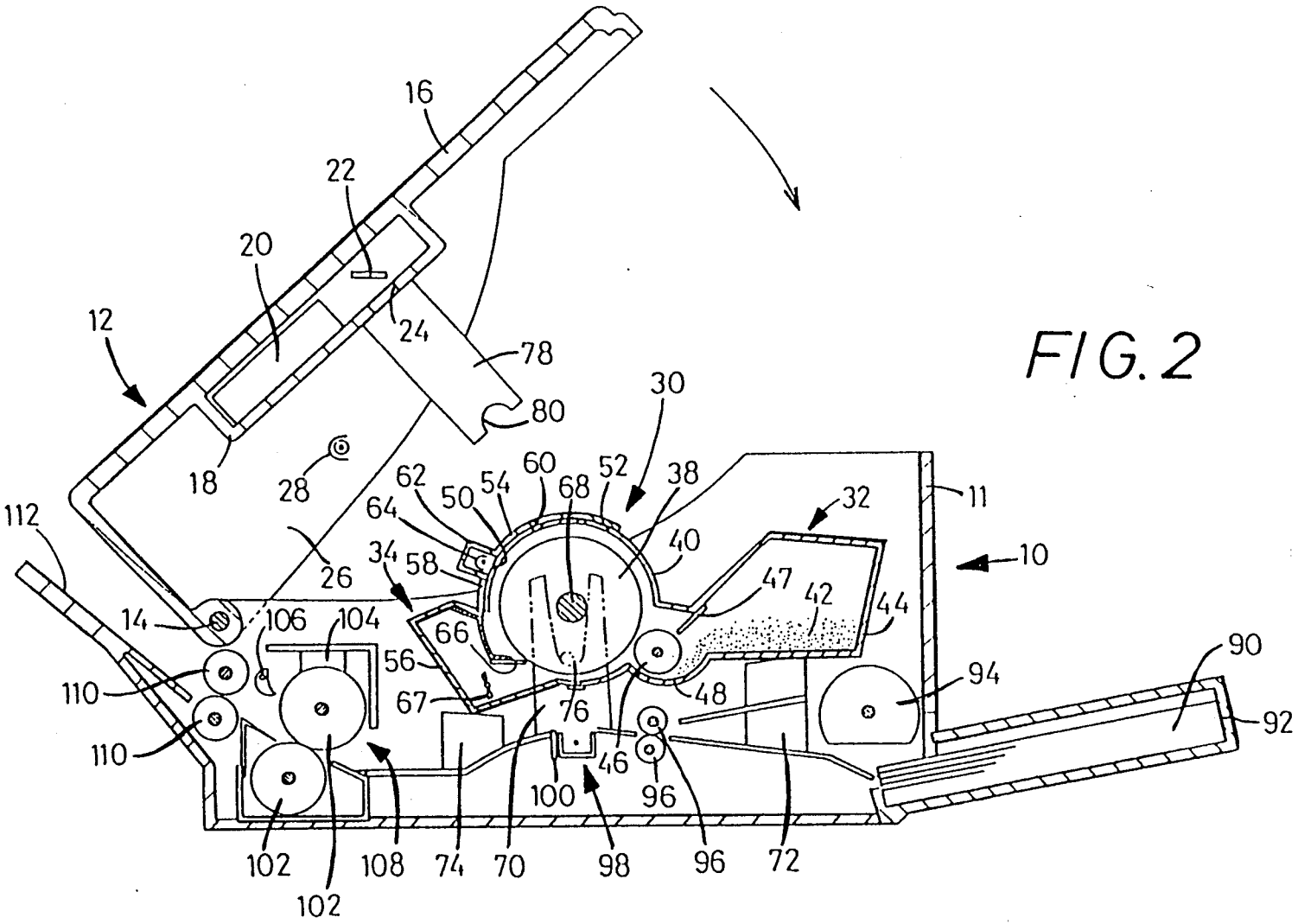
FIG. 2 is an elevational view showing the laser printer of FIG. 1 with its cover placed in the open position.

Referring first to FIGS. 1 and 2, reference numeral 10 denotes a laser printer 10 as a photographic recording apparatus embodying the present invention. The laser printer 10 has a housing body 11, and a cover 12 which is pivotally mounted on the housing body 11 such that the cover 12 is pivotable about a pivot axis 14 at one end of the housing body 11, between a closed position of FIG. 1 and an open position of FIG. 2. In the closed position, the cover 12 closes a top opening of the housing body 11.

The cover 12 includes a top plate 16 which is provided with a laser scanner section 18 formed on the inner surface. The laser scanner section 18 accommodates a laser scanner unit 20 and a reflecting mirror 22, which are provided to effect an exposing operation described below. The laser scanner unit 20 includes a semiconductor laser source for producing a laser beam, a collimator lens, a polygon mirror, and other optical components. These optical components are disposed so that the laser beam is reflected by the reflecting mirror 22 and is passed into the interior of the printer 10, as indicated in one-dot chain line in FIG. 1, through an aperture 24 formed through the laser scanner section 18.

The cover 12 has opposite side walls 26 perpendicular to the pivot axis 14, and a preliminary exposing lamp 28 which extends between these side walls 26.

Figure 3:
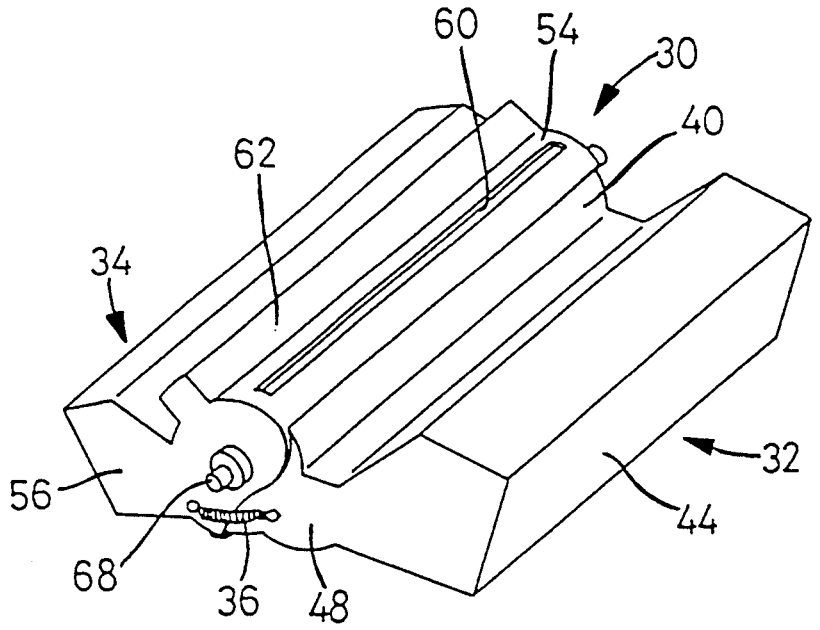
FIG. 3 is a perspective view showing a process cartridge unit which is removably installed in the printer of FIG. 1.
Figure 4:
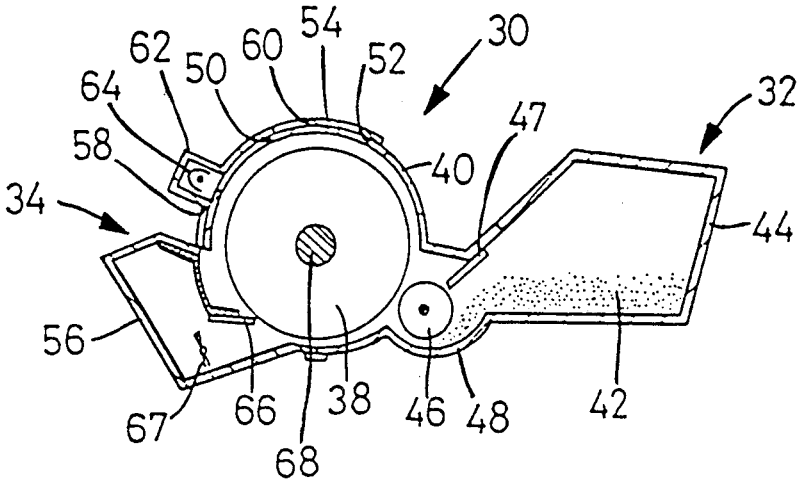
FIG. 4 is a front elevational view in cross section of the cartridge unit of FIG. 3 placed in a first position.
Figure 5:
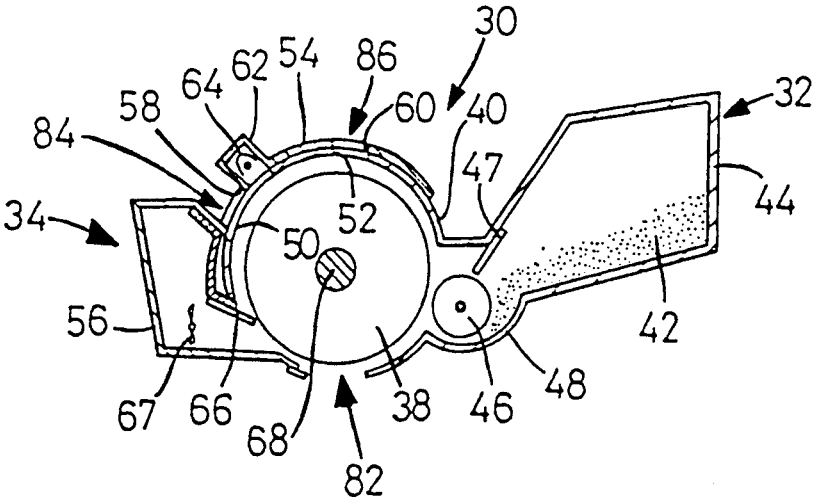
FIG. 5 is a front elevational view showing the cartridge unit placed in a second position.

On the housing body 11, there is removably mounted a process cartridge unit 30. As shown in FIG. 3, the cartridge unit 30 includes a first frame 32, a second frame 34, and biasing means in the form of a coil spring 36 disposed between these two frames 32, 34 for biasing the frames. As shown in FIGS. 4 and 5, the cartridge unit 30 includes a photoconductive drum 38, and a developing device which has a developing roll 46 and a blade 47. The first frame 32 consists of a covering portion in the form of a part-cylindrical portion 40, a toner storage portion 44, and a developer support portion 48 between the part-cylindrical and toner storage portions 40, 44. The part-cylindrical portion 40 is concentric with the photoconductive drum 38 and covers about three-quarters (3/4) of the circumference of the photoconductive drum 38. The toner storage portion 44 has a polygonal cross sectional shape (as seen in FIGS. 4 and 5) and is adapted to store a mass of a toner 42. The developer support portion 48 supports the developing roll 46 and blade 47 accommodated therein.

The part-cylindrical portion 40 of the first frame 32 has a first through-hole 50 and a second through-hole 52 which extend in the axial direction of the drum 38 and are spaced apart from each other in the circumferential direction of the drum 38.

The second frame 34 consists of a covering portion in the form of a part-cylindrical portion 54 for covering a part of the circumference of the photoconductive drum 38, and another covering portion in the form of a cleaner support portion 56 which covers another part of the circumference of the drum 38. As seen in FIGS. 4 and 5, the cleaner support portion 56 has a rectangular cross sectional shape. The part-cylindrical portion 54 is concentric with and partially overlaps the part-cylindrical portion 40 of the first frame 32. The part-cylindrical portion 54 has a third and a fourth through-hole 58, 60 which correspond to the first and second through-holes 50, 52 of the first frame 32. These third and fourth through-holes 58, 60 has the same spacing as that of the first and second through-holes 50, 52 in the circumferential direction of the drum 38.

The cartridge unit 30 also includes a charger 64 accommodated in an elongate channel 62 formed with the part-cylindrical portion 54 of the second frame 34, so as to extend in the axial direction of the photoconductive drum 38. The cartridge unit 30 further includes a cleaner 66 in sliding contact with a circumferential surface of the photoconductive drum 38, and a guide vane 67 adjacent to the cleaner 66. These cleaner and guide vane 66, 67 are supported in the cleaner support portion 56.

The first and second frames 32, 34 are disposed on substantially diametrically opposite sides of the photoconductive drum 38, such that the two frames 32, 34 are pivotable about a shaft 68 fixed to the drum 38, relative to and independently of each other, between a first relative angular position of FIG. 4, and a second relative angular position of FIG. 5. The shaft 68 extends from the opposite end faces of the drum 38.

When the process cartridge unit 30 is not installed on the laser printer 10, the first and second frames 32, 34 are held in the first relative angular position of FIG. 4 under the biasing force of the coil spring 36. In this first relative angular position, the first and second through-holes 50, 52 of the first frame 32 are closed by the part-cylindrical portion 54 of the second frame 34, while the third and fourth through-holes 58, 60 of the second frame 34 are closed by the part-cylindrical portion 40 of the first frame 32. At the same time, the lower end of the part-cylindrical portion 40 and the corresponding lower end of the cleaner support portion 56 which are right below the rotation axis of the drum 38 are held in abutting contact with each other, whereby the entire circumference of the drum 38 is covered by the first and second frames 32, 34 in the first relative angular position, as indicated in FIG. 4.

In the second relative angular position of the first and second frames 32, 34, the corresponding lower ends of the part-cylindrical portion 40 and cleaner support portion 56 are spaced apart from each other in the circumferential direction of the drum 38, whereby a first opening in the form of an image transfer opening 82 is formed below the drum 38, so as to extend in the axis direction of the drum 38. Further, the first and second through-holes 50, 52 of the first frame 32 are aligned with the third and fourth through-holes 58, 60 of the second frame 34, respectively, whereby a second and a third opening in the form of a first and a second exposing aperture 84, 86 are formed through the part-cylindrical portions 40, 54 of the first and second frames 32, 34.

The housing 11 has a pair of first support portions 70, a pair of second support portions 72 and a pair of third support portions 74. The two portions of each of these pairs 70, 72, 74 are spaced part from each other in the axial direction of the photoconductive drum 38. In FIGS. 1 and 2, only one of the two support portions of each pair is shown. The pair of first support portions 70 are aligned with the end portions of the shaft 76 in the axial direction of the drum 38. Each of the first support portion 70 has a free end which is bifurcated to provide a U-shaped guide groove 76 which is open upwards, so that the end portions of the shaft 68 extending through the first and second frames 32, 34 of the cartridge unit 30 are engageable with the guide grooves 76 of the corresponding first support portions 70.

The pair of second support portions 72 are adapted to support the cartridge unit 30 on the bottom wall of the first frame 32, while the pair of third support portions 74 are adapted to support the cartridge unit 30 at the underside of the second frame 34. More specifically, the first, second and third support portions 70, 72, 74 are dimensioned, shaped and positioned so that the upper ends of the second and third support portions 72, 74 are held in abutting contact with the undersides of the first and second frames 32, 34, respectively, when the end portions of the shaft 68 engage the bottom portions of the appropriate U-shaped guide grooves 76, as indicated in FIG. 1.

The cover 12 is provided with retainer means in the form of a pair of retainer arms 78 which extend from the inner surface of the top plate 16 toward the interior of the housing body 11. These pair of retainer arms 78 are aligned with the pair of first support portions 70 of the housing body 11. In FIGS. 1 and 2, only one of the two retainer arms pivoted to the closed position. In this case, the covering 78 is shown. Each of the retainer arms 78 has a free end which has a semicircular cutout 80 whose diameter is substantially the same as that of the shaft 68 of the drum 38. When the cover 12 is pivoted from the open position of FIG. 2 to the closed position of FIG. 1, as indicated by arrow in FIG. 2, the semicircular cutouts 80 of the retainer arms 78 are brought into engagement with the end portions of the shaft 68, whereby the photoconductive drum 38 is moved downwards until the shaft 68 engages the bottom portions of the U-shaped guide grooves 76 of the first support portions 70. As a result, the first and second frames 32, 34 in the first relative angular position of FIG. 4 are pivoted relative to each other to the second relative angular position of FIG. 5.

When the cartridge unit 30 is merely placed on the second and third support portions 72, 74 of the housing body 11, the first and second frames 32, 34 are maintained in the first relative angular position under the biasing action of the coil spring 36. In this condition, the shaft 68 is spaced from the bottom portions of the U-shaped guide grooves 76 of the first support portions 70. With the cover 12 pivoted to the closed position, the shaft 68 and the drum 38 are moved downwards by the retainer arms 78, as described above. Consequently, the first frame 32 is pivoted in the counterclockwise direction about a point of contact with the second support portions 72, against the biasing force of the spring 36, while the second frame 34 is pivoted in the clockwise direction about a point of contact with the third support portions 74, also against the biasing force of the spring 36. When the cover 12 reaches the closed position to completely close the opening of the housing body 11, the end portions of the shaft 68 are brought into complete engagement with the bottom portions of the guide grooves 76. In this manner, the first and second frames 32, 34 are pivoted from the first relative angular position to the second relative angular position as the cover 12 is pivoted from the open position to the closed position.

It will be understood from the above description that the first, second and third support portions 70, 72, 74 and the retainer arms 78 constitute a cartridge holding portion for holding the cartridge unit 30 such that the first and second frames 32, 34 are placed in the second relative angular position, in which the first and second exposing apertures 84, 86 and the image transfer opening 82 are formed through the first and second frames 32, 34.

The laser printer 10 is equipped with the following components which are disposed in the order of description from the right-hand side to the left-hand side of the printer as seen in FIG. 1: a sheet cassette 92 for accommodating a stack of recording cut sheets 90; a pick-up roll 94 for delivering the cut sheets 90 one after another; a pair of registering rolls 96 for registering the sheets 90 in timed relation with the angular phase of the drum 38; an image transfer charger 98 for transferring a pattern of the toner 42 (visible image) from the photoconductive drum 38 onto the sheets 90; a discharging blade 100 for discharging the sheets 90; an image fixing device 108 having a pair of fixing rolls 102 for fixing the toner 42 on the sheets 90, a cleaner 104 and a separator jaw 106; and a pair of ejector rolls 110. Each sheet 90 is fed along a path defined by the above components, and is received on a tray 112. Within a bottom portion of the housing body 11, there is provided a control section which has printed-circuit boards provided with memory means storing control programs for controlling a laser printing operation.

When the cartridge unit 30 is installed in position on the housing body 11, the three openings 82, 84, 86 are automatically formed so that a lower part of the circumference of the photoconductive drum 38 faces the image transfer charger 98 through the image transfer opening 82. At the same time, a relatively upper part of the circumference of the drum 38 faces the preliminary exposing lamp 28 and charger 64 through the first exposing aperture 84, while another upper part of the drum 38 faces the reflecting mirror 22 through the second exposing aperture 86.

In a laser printing operation of the present laser printer 10, the circumferential surface of the photoconductive drum 38 is exposed through the aperture 84 to a light emitted by the preliminary exposing lamp 28, at a circumferential position slightly upstream of the charger 64 in the rotating direction of the drum 38. Thus, the circumferential surface of the drum 38 is subjected to a preliminary exposure by the lamp 28. The thus exposed portion of the drum 38 is uniformly charged by the charger 64 also through the aperture 84. The uniformly charged portion of the drum 38 is then image-wise exposed through the aperture 86 to a laser beam which is generated from the laser scanner unit 20 and reflected from the mirror 22. This laser beam is deflected to effect scanning along a line on the drum 38, according to source image information representative of an original image to be reproduced. Thus, a line of latent image is formed on the surface of the drum 38. This latent image is developed into a visible image by application of the toner 42 by the developing roll 46 to the appropriate local spots on the drum 38.

In the meantime, a recording cut sheet 90 is delivered from the sheet cassette 92 by the pick-up roll 94, and is fed by the registering rolls 96 through an image transfer station between the lowest point of the circumference of the drum 38 and the image transfer charger 98. The registering rolls 96 are adapted to feed the sheet 90 to the image transfer station in a predetermined timed relation with respect to the angular phase of the drum 38. Thus, the visible image of the toner 42 is transferred to the sheet 90. The sheet 90 leaves the discharging blade 100 at the end of the charger 90 is ejected onto the tray 112 through the image fixing device 108. At the same time, the circumferential surface of the drum 38 is cleaned by the cleaner 66 in the second frame 34, to remove the remaining particles of the toner 42.

When the cartridge unit 30 is replaced with a new one, the cover 12 is pivoted from the closed position of FIG. 1 to the open position of FIG. 2. Consequently, the retainer arms 78 are separated from the shaft 68 of the drum 38, whereby the first and second frames 32, 34 are pivoted from the second relative angular position of FIG. 1 to the first relative angular position of FIG. 2. In this first position, the shaft 68 is disengaged from the bottom portions of the U-shaped guide grooves 76 of the first support portions 70 of the housing body 11. In this condition, the cartridge unit 30 is removed from the housing body 11, and the new cartridge unit 30 in the first relative angular position is placed on the second and third support portions 72, 74. Then, the cover 12 is pivoted to the closed position, to pivot the first and second frames 32, 34 of the new cartridge unit 30 to the second relative angular position of FIG. 1, to thereby form the image transfer opening 82 and the first and second exposing apertures 84, 86. The present laser printer 10 and the cartridge unit 30 permit easy replacement of the cartridge unit 30 with a new one, while protecting the photoconductive drum 38 of the new cartridge unit from exposure to light.

Where the cartridge unit 30 for imaging in a given color is temporarily removed from the housing body 11 during operation of the printer 11 using another cartridge unit for imaging in another color, the drum 38 of the removed cartridge unit 30 is protected from exposure to light, since the removal results in automatic closure of the three openings 82, 84, 86 with the frames 32, 34 pivoted to the first relative angular position of FIG. 2. Further, the surface of the drum 38 is protected from damage during the replacement procedure.

In the present laser printer 10, there is provided a comparatively ample clearance between the cartridge unit 30 and the assembly of the image transfer charger 98 and registering rolls 96, in the first relative angular position of the frames 32, 34, as indicated in FIG. 2. Accordingly, the sheet 90 jammed in the feed path below the cartridge unit 30 may be easily removed, and the toner 42 outside the unit 30 may be easily wiped off before the unit 30 is removed from the printer 10.

While the present invention has been described above in the presently preferred embodiment, it is to be understood that the invention is not limited to the details of the illustrated embodiment, but may be embodied with various changes, modifications and improvements, which may occur to those skilled in the art, without departing from the spirit and scope of the invention defined in the appended claims.

For instance, the first and second frames 32, 34 of the process cartridge unit 30 may be modified in configuration, and number and position of the openings. Further, the principle of the present invention is applicable to other types of photographic recording apparatus, provided that recording apparatus uses a process cartridge unit which includes a photoconductive drum which is optically image-wise exposed to form a latent image.

What is claimed is:

1. A photographic recording apparatus having a housing body, and a process cartridge unit which includes a rotatable photoconductive drum and a developing device and which is removably mounted on the housing body, said drum having an axis of rotation, wherein the improvement comprises:

said process cartridge unit including a first frame which supports said developing device and which is pivotable about said axis of rotation of said photoconductive drum, a second frame which is pivotable about said axis of rotation relative to said first frame, and biasing means for biasing said first and second frames and thereby holding said first and second frames in a first relative angular position;

said housing body including a cartridge holding portion for holding said process cartridge unit such that said first and second frames are held in a second relative angular position, said second relative angular position being established by pivoting said first and second frames relative to each other from said first relative angular position against a biasing action of said biasing means, said photoconductive drum being removable from said housing body, together with said first and second frames; and said first and second frames cooperating to provide at least one opening through which a portion of said photoconductive drum is exposed to an outside of said first and second frames, when said first and second frames are placed in said second relative angular position, said at least one opening being closed when said first and second frames are placed in said first relative angular position.

2. A photographic recording apparatus according to claim 1, wherein said first and second frames of said process cartridge unit have respective covering portions which are movable relative to each other and which cover a part of a circumference of said photoconductive drum such that said covering portions partially overlap each other, and providing at least one of said at least one opening when said first and second frames are placed in said second relative angular position.

3. A photographic recording apparatus according to claim 2, wherein each of said covering portions of said first and second frames has at least one hole formed therethrough, said at least one hole of said first frame and said at least one hole of said second frame being misaligned with each other in said first relative angular position, and aligned with each other to provide said at least one of said at least one opening in said second relative angular position.

4. A photographic recording apparatus according to claim 3, wherein each of said covering portions of said first and second frames has two holes formed therethrough to provide two openings in said second relative angular position.

5. A photographic recording apparatus according to claim 1, wherein said first frame includes a developer support portion for supporting said developing device, and a covering portion which is adjacent to said developer support portion and which covers a part of a circumference of said photoconductive drum when said first and second frames are placed in said first relative angular position, said second frame including a covering portion which covers another part of said circumference adjacent to said part when said first and second frames are placed in said first relative angular position, said covering portions of said first and second frames having respective ends which are spaced apart from each other in a circumferential direction of said drum to thereby define an opening therebetween when said first and second frames are placed in said second relative angular position.

6. A photographic recording apparatus according to claim 5, wherein said process cartridge unit further includes a cleaner, and said first frame further includes a toner storage portion for storing a toner which is applied to a circumferential surface of said photoconductive drum by said developing device, said covering portion of said second frame including a cleaner support portion for supporting said cleaner, said cleaner support portion having an end which cooperates with the end of said covering portion of said first frame to define a toner transfer opening through which said toner is transferred from said circumferential surface of said drum to a recording medium, said cleaner being located downstream of said toner transfer opening in a rotating direction of said drum, and operating to remove said toner which remains on said circumferential surface.

7. A photographic recording apparatus according to claim 1, wherein said cartridge holding portion of said housing body includes first, second and third support means for supporting said process cartridge unit at said photoconductive drum, said first frame and said second frame, respectively, when said first and second frames are placed in said second relative angular position.

8. A photographic recording apparatus according to claim 7, wherein when said first and second frames are placed in said first relative angular position, said second and third support means support said process cartridge unit in contact with said first and second frames, respectively, with said photoconductive drum being disengaged from said first support means, said drum and said first support means engaging each other when said first and second frames are pivoted relative to each other about said axis of rotation into said second relative angular position.

9. A photographic recording apparatus according to claim 8, wherein said photoconductive drum has a shaft portion which engages said first support means when said first and second frames are pivoted about said shaft portion to said second relative angular position.

10. A photographic recording apparatus according to claim 9, wherein said first support means has a U-shaped groove which is open so as to engage said shaft portion when said first and second frames are pivoted to said second relative angular position.

11. A photographic recording apparatus according to claim 9, further comprising a covering member which is supported by said housing body pivotally between an open and a closed position, said covering member in said closed position cooperating with said housing body to enclose said process cartridge unit, said covering member having retainer means which extends toward an interior of said housing body, said retainer means being engageable with said shaft portion of said photoconductive drum and thereby pivoting said first and second frames from said first relative angular position to said second relative angular position when said covering member is pivoted to said closed position.

12. A photographic recording apparatus according to claim 11, wherein said covering member includes a top plate from which said retaining means extends downward for engagement with said shaft portion of said photoconductive drum when said covering member is moved to said closed position.

13. A photographic recording apparatus according to claim 1, wherein said at least one opening comprises an exposing aperture through which a circumferential surface of said photoconductive drum is exposed to a light beam representative of an original image to be reproduced, whereby a latent image corresponding to said original image is formed on said circumferential surface.

14. A photographic recording apparatus according to claim 13, wherein said at least one opening further comprises an image transfer opening through which a visible image developed from said latent image by said developing device is transferred to a recording medium.

15. A photographic recording apparatus according to claim 1, further comprising a laser scanner unit for exposing a circumferential surface of said photoconductive drum through one of said at least one opening, to a laser beam representative of an original image to be reproduced.

16. A photographic recording apparatus having a housing body, and a process cartridge unit which includes a rotatable photoconductive drum and a developing device and which is removably mounted on the housing body, said drum having an axis of rotation, wherein the improvement comprises:

said process cartridge unit including a first frame which supports said developing device and which is pivotable about said axis of rotation of said photoconductive drum, a second frame which is pivotable about said axis of rotation relative to said first frame, and biasing means for biasing said first and second frames and thereby holding said first and second frames in a first relative angular position;

said first and second frames having respective covering portions which are movable relative to each other and which cover a part of a circumference of said photoconductive drum such that said covering portions partially overlap each other;

said housing body including a cartridge holding portion for holding said process cartridge unit such that said first and second frames are held in a second relative angular position, said second relative angular position being established by pivoting said first and second frames relative to each other from said first relative angular position against a biasing action of said biasing means; and said covering portions of said first and second frames cooperating to provide at least one opening through which a portion of said photoconductive drum is exposed to an outside of said first and second frames, when said first and second frames are placed in said second relative angular position, said at least one opening being closed when said first and second frames are placed in said first relative angular position.

17. A photographic recording apparatus according to claim 16, wherein each of said covering portions of said first and second frames has at least one hole formed therethrough, said at leas tone hole of said first frame and said at least one hole of said second frame being misaligned with each other in said first relative angular position, and aligned with each other to provide said at least one of said at least one opening in said second relative angular position.

* * * * *